US006800014B2

(12) United States Patent
Dominici et al.

(10) Patent No.: US 6,800,014 B2
(45) Date of Patent: Oct. 5, 2004

(54) DEVICE TO OBTAIN LENGTHENING OF THE LIMBS AND/OR OTHER PARTS OF THE BODY OF A PUPPET, SUCH AS FOR EXAMPLE A DOLL AND OTHER SIMILAR TOYS SUCH AS SMALL ANIMALS, SOFT TOYS AND SIMILAR

(76) Inventors: Carlo Maria Dominici, via F. Sivori, 34, I-00136 Rome (IT); Alberto Gregori, via Quinto Novio, 44, I-00175 Rome (IT); Claudio Rosa, via dell 'Astore 48, I-00169 Rome (IT)

( * ) Notice: Subject to any disclaimer, the term of this patent is extended or adjusted under 35 U.S.C. 154(b) by 0 days.

(21) Appl. No.: 10/343,003

(22) PCT Filed: Jul. 30, 2001

(86) PCT No.: PCT/IT01/00420

§ 371 (c)(1),
(2), (4) Date: Jun. 11, 2003

(87) PCT Pub. No.: WO02/09834

PCT Pub. Date: Feb. 7, 2002

(65) Prior Publication Data

US 2004/0121701 A1 Jun. 24, 2004

(30) Foreign Application Priority Data

Jul. 31, 2000 (IT) ..... RM2000A0426

(51) Int. Cl.[7] ..... A63H 13/00
(52) U.S. Cl. ..... 446/320; 446/338
(58) Field of Search ..... 446/300, 320, 446/323, 338, 339, 340, 183, 193, 199, 322, 390, 391; 434/262, 273

(56) References Cited

U.S. PATENT DOCUMENTS

| | | | | | |
|---|---|---|---|---|---|
| 3,964,205 | A | * | 6/1976 | Kuramochi | 446/338 |
| 4,246,722 | A | * | 1/1981 | Sapkus et al. | 446/320 |
| 4,576,585 | A | * | 3/1986 | Balogh et al. | 446/199 |
| 4,622,021 | A | * | 11/1986 | Darrigo, Sr. | 446/320 |
| 5,162,013 | A | * | 11/1992 | von Mohr | 446/320 |
| 5,310,380 | A | * | 5/1994 | Levy et al. | 446/489 |
| 6,155,904 | A | * | 12/2000 | Spector | 446/320 |
| 6,413,142 | B1 | * | 7/2002 | Weastler | 446/320 |
| 6,568,984 | B1 | * | 5/2003 | Applewhite | 446/176 |
| 6,572,432 | B1 | * | 6/2003 | Tsai | 446/320 |
| 6,679,749 | B2 | * | 1/2004 | Yu | 446/71 |

* cited by examiner

*Primary Examiner*—Jacob K. Ackun
*Assistant Examiner*—Faye Francis
(74) *Attorney, Agent, or Firm*—Breiner & Breiner, L.L.C.

(57) ABSTRACT

The object of the present invention is a device by means of which simulation of the lengthening of shortening of, for example, a limb is obtaining by construction of a telescoping structure, the mutual sliding of which, and therefore the lengthening or shortening is controlled by means of threads that are rolled or unrolled from a disk shaped like one or more side-by-side pulleys. Thanks also to the action of a counteracting spring. The movement of the spools is controlled by a circuit that registers shaking and therefore playing with the toy according to the equation, more playing=more growth (that is, more shaking more growth).

11 Claims, 5 Drawing Sheets

DEVICE TO OBTAIN LENGTHENING OF THE LIMBS AND/OR OTHER PARTS OF THE BODY OF A PUPPET, SUCH AS FOR EXAMPLE A DOLL AND OTHER SIMILAR TOYS SUCH AS SMALL ANIMALS, SOFT TOYS AND SIMILAR

FIELD OF THE INVENTION

This present invention concerns a device obtain lengthening of the limbs and/or other parts of the body of a puppet, such as for example a doll including in a semiautomatic form, as reaction determined by a specific electronic device, on use of the toy.

STATE OF THE ART

It is well-known that in the field of toys there is continuous research to create objects that stimulate children's imagination and make their toys more interesting and involving.

In the doll field, for example, a great many models have been created that imitate the sounds and movements of the newborn, of infants and adults in such a way that the child who plays with them can easily immerse itself in the role of the mother, of the newborn or of the adult, but until now no one has been able to produce a device that would allow a doll or other puppet to vary the length of the limbs and/or other parts of the body in such a way as to simulate growth by simple and therefore durable and cheap means.

The solution has been sought, but the mechanisms created have been complex and costly, using pneumatic systems that inflate an outer covering, or mechanical systems with gears, or others such as those described in the patents listed below.

In U.S. Pat. No. 4,622,021 of 1986 there is described a rod connected to a thread which is pulled from the outside and gives the sensation of lengthening.

In U.S. Pat. No. 5,125,865 of 1992 there is described a mechanism which, creating a depression on the mouth, with manual action, simulates chewing and thus the doll grows thanks to the external manual action.

In U.S. Pat. No. 4,828,528 of 1981 there are described cloths sewn in the form of bellows which inflate one by one when a thread is pulled, giving the sensation of growth In U.S. Pat. No. 4,246,722 of 1981 there are described internal gears by means of which a post to which the head of the doll is fixed is operated. The necessary energy is supplied manually operating a spring-loaded system from the outside.

It is thus evident from what has been briefly described that the devices described do not solve brilliantly the requirement to make the limbs of a doll or similar grow.

FUNDAMENTALS OF THE INVENTION

The object of this present invention is a device by means of which simulation of the lengthening of shortening of, for example, a limb is achieved by creating a telescopic structure, sliding of which to create lengthening of shortening is controlled by threads that are rolled or unrolled on a disc shaped like one or more side-by-side pulleys, thanks also to the action of a counteracting spring. The movement of the spools is controlled by a circuit that registers shaking and therefore playing with the toy according to the equation, more playing=more growth (that is, more shaking more growth). Growth of the toy determines a further phase of play that coincides with the need, for example, to change the doll's clothes, since its growth has made them too small.

The device will be described in the attached drawings in which:

BRIEF DESCRIPTION OF THE DRAWINGS

FIG. 7.1 shows a view from above of the external container. In other words, the doll's thorax, which is sectioned in such a way as to show what happens inside when the breast also grows. The rear part is on the left of the Figure and is sectioned near the electric motor, whereas the front part is on the right and sectioned near the breast passage holes.

FIG. 8.1 shows a sectioned lateral view of the external container, in other words the thorax of the doll, which is sectioned in such a way as to show what happens internally when the breast grows, The rear part of the Figure is sectioned near the breast passage holes.

DESCRIPTION OF THE INVENTION

Figure 1:
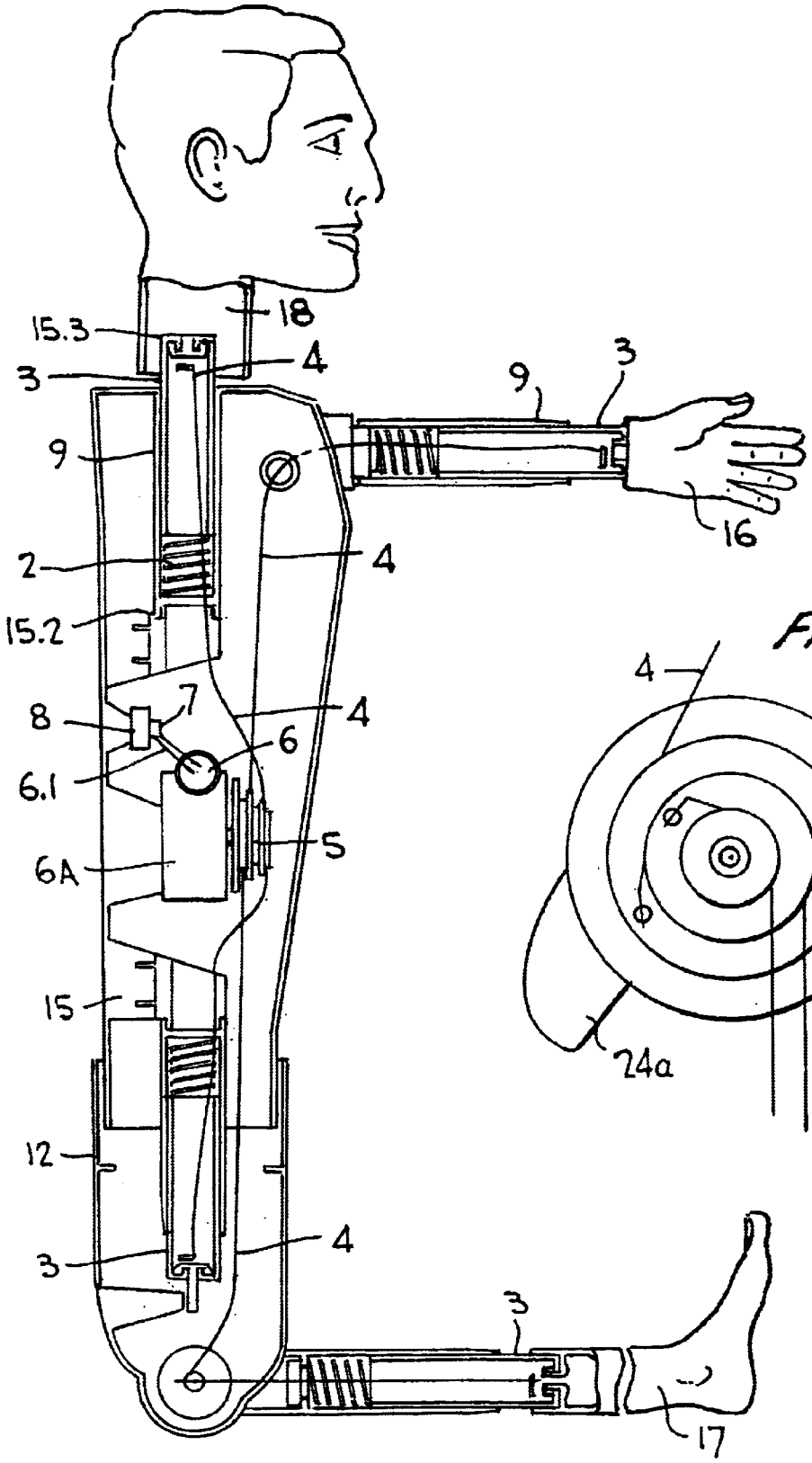
FIG. 1 shows a view in longitudinal section of the device applied to a doll

With reference to the said figures, the simulation for example of the growth of a limb is obtained with the particular (1) in thermoplastic in the form of a tube with a restriction of the internal section supporting a spring (2) at the part (1.1) and supporting the gluing to the remaining part of the limb at the part 1.2, whereas at the other extremity 1.3 it is tapered to obtain an aesthetically correct coupling with the particular 3, which represents the sliding part of the extensible arm, because, at extremity 3.1, it allows the reaction with the spring 2, which is compressed or released according to whether the cable 4, connected in 3.2, or fixed with a section of yielding metal cylinder 3.2*a*, appropriately deformed by squashing, is extended or withdrawn.

Extension or withdrawal of the cable 4 takes place by action of the pulley 5, with a fixing hole 5.1 for the cable 4, governed by the motor 6, controlled by an electronic circuit 7 powered by an accumulator 8.

The particular 3 has a joint 3.3 for connection by joint or gluing of the front part of the extensible organ 3 to the rest of the limb.

According to this present invention as shown in FIG. 1, in a toy that requires elongation of the limbs or other parts of the body, for example a doll, there is an electronic control circuit (7) which recognises whether the user has used, touched or moved the toy. This requisite is important, because if the user relates to the toy, the growth that the toy's mechanisms make available becomes visible almost immediately.

The electronic circuit 7 has, as said, a device for recording the number and frequency of the shakes the toy receives. These are the parameters utilised to give consent to growth. That happens because, in the presence of the events described, the electronic circuit 7 sends a command and the necessary energy, taken from the accumulator 8, to the electric motor 6—connected by the electric wires 6.1—which starts up and drives the reducer 8*a*, connected through pulley 5 and the cables 4 to the extremity of the extensible organ 3, permitting the amount of extension provided for.

Figure 2:
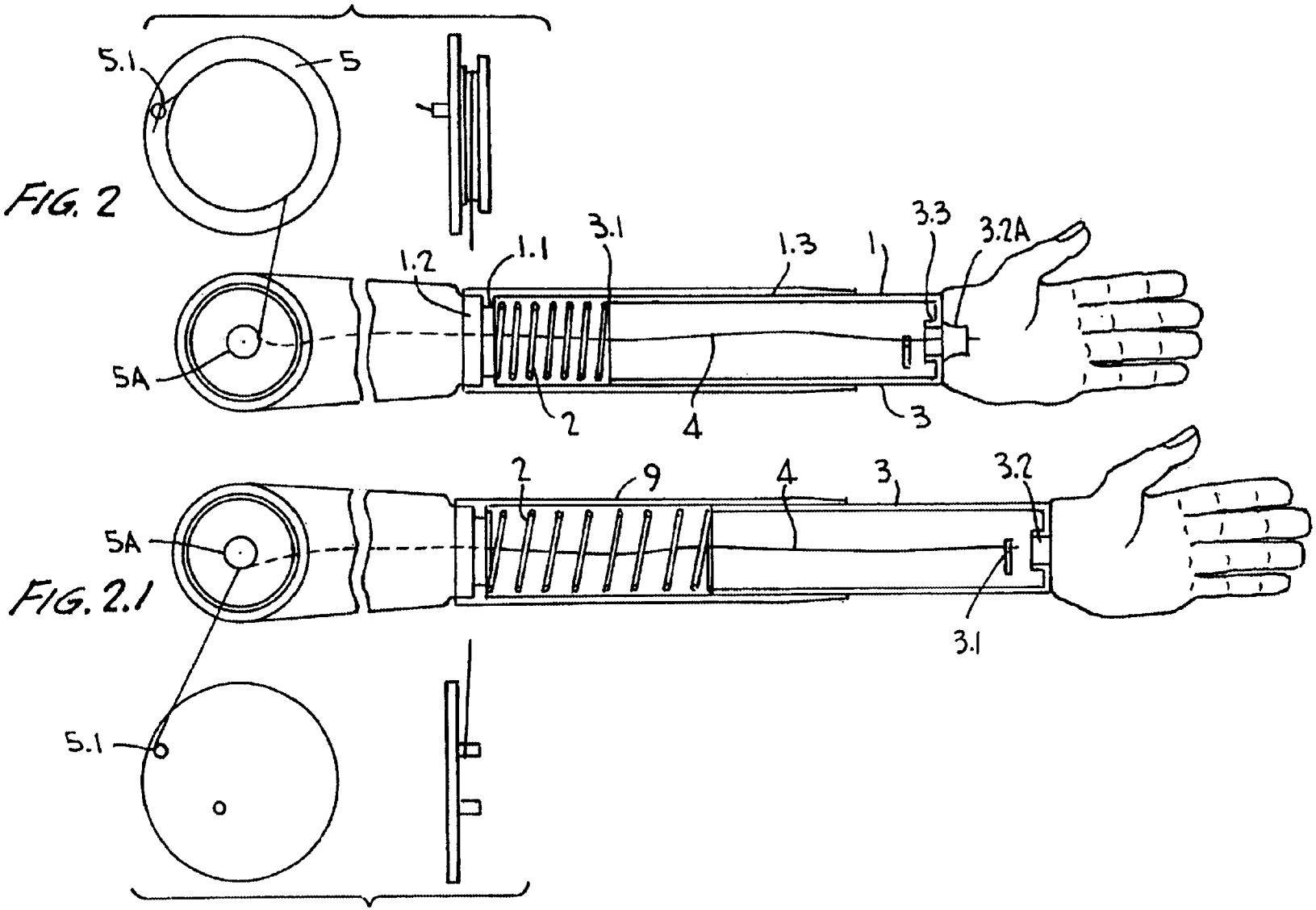
FIG. 2 shows a view in longitudinal section of the detail of an arm connected by an appropriate thread to a pulley FIG. 2.1 shows a view in longitudinal section of the detail of an arm connected to a disk with cam

The electric motor 6, following consent from the electronic circuit 7, rotates and draws with it the cams 5.1*a* positioned on the disc 5*a* or the pulley 5 of FIG. 2 which—see FIG. 2.1—slackening the cable 4. The spring 2 is no longer compressed and expands, moving the particular 3, providing evidence of the lengthening of the limb. At that point the doll's clothes have become short and tight and the user has to change them, thus meeting a natural need which will be learned quickly and indelibly.

The electronic circuit is calibrated in such a way that if, for example, the toy is not used for 100 hours, the limbs and other parts of the body shrink and retract to the original position of FIG. 1, showing an evident and apparent slovenly aspect, because the clothes have suddenly become too large and too long.

Figure 3:
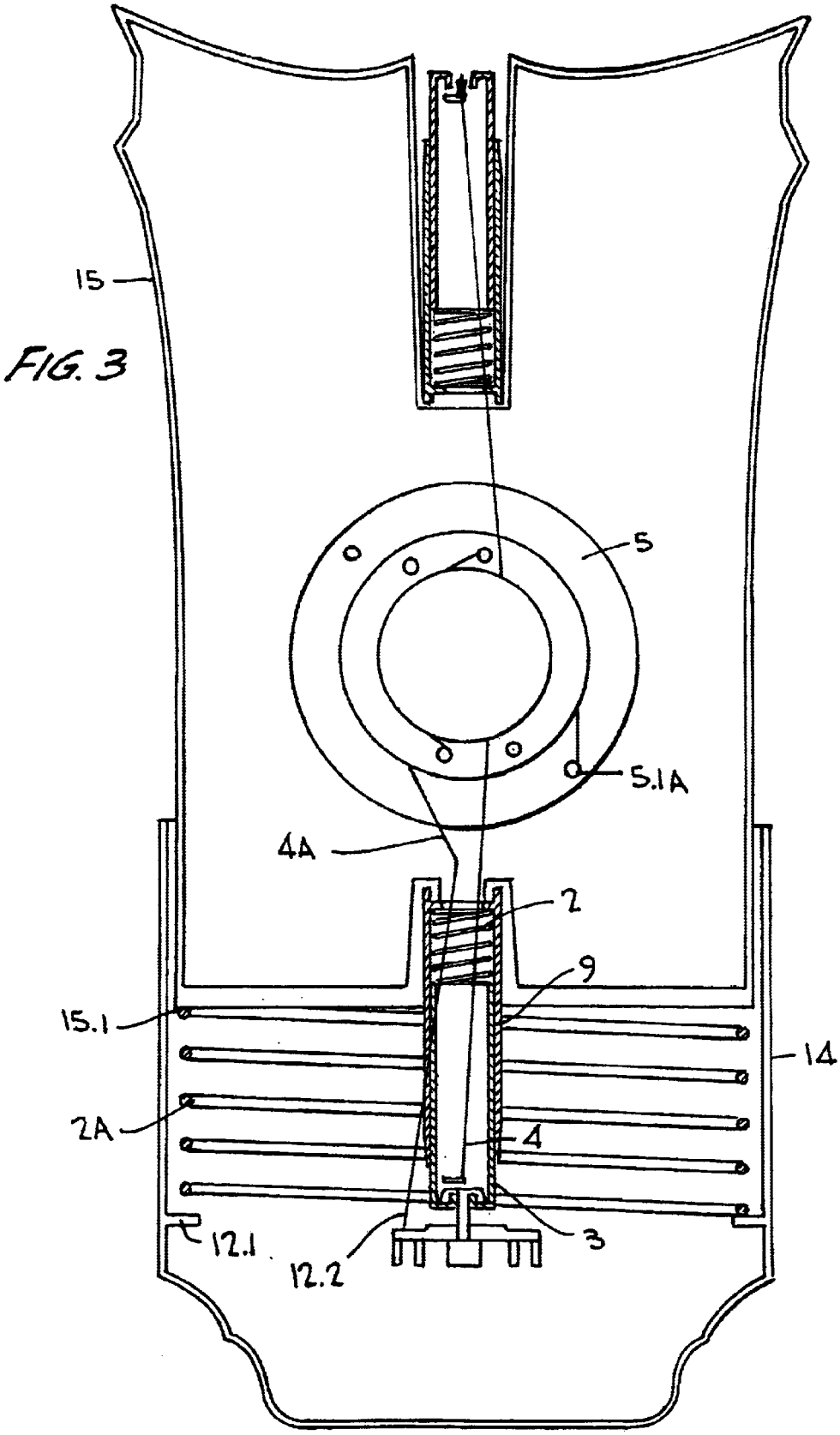
FIG. 3 shows a view in longitudinal front section of the trunk

FIG. 3 shows a preferential section of the bust in which it can be seen that the device of FIGS. 2 and 2.1 consists of an outer piece 9 and an inner piece 3 which are connected by slotting in to the lower and upper part of the bust respectively and keep the spring 2 compressed thanks to the action described above of the cable 4. They represent a solution for lengthening and shortening the limbs and other parts of the toy's body.

Again in FIG. 3, one sees an alternative solution for extension of the bust by which the lengthening and shortening of this part of the body is obtained by the spring 2*a*, which is compressed between the upper and lower parts of the bust thanks to the reaction points 12.1 and 15.1, when the lower part is connected directly to the pulley 5. through the weakly elastic cable 4*a* fixed to the support 12.2. This is possible because the two sections of the bust slide over each other like the sections of a telescope, like the particulars indicated in FIGS. 2 and 2.1, and also because the distance the thread moves to ensure the functioning is appropriately determined through idler pins and bearings to reduce friction and hence the size of the motor.

In FIG. 3 we see the result achieved for the pelvis. In FIG. 1 the same extension elements of FIG. 2—jointed or glued in the points 15.2 and 15.3 through the cable 4 connected to the pulley 5—keep the spring 2 compressed or determine an extended position for it, managing to show the extension envisaged for the neck, too.

Figure 4:
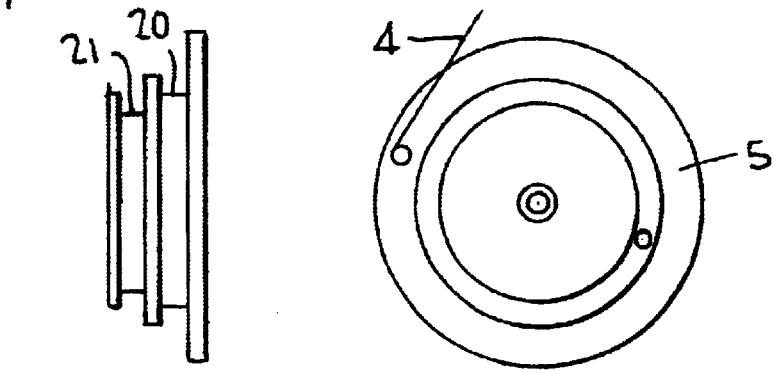
FIG. 4 shows a front and side view of a 2-stage pulley to obtain two different degrees of lengthening with the same angular rotation

FIG. 4 shows the reason why the legs connected with thread 4 lengthen more that the arms. As can be seen, the pulleys differ in their radius and pulley 20 has a greater radius than pulley 21. For the same number of rotations, therefore, cable 4 is wrapped less around pulley 20 than it is around pulley 21. When, for the reasons described, the electronics 8 give permission to slacken cable 4, the pulley moves through an fixed angle, whereas the two cables travel different distances.

Figure 5:
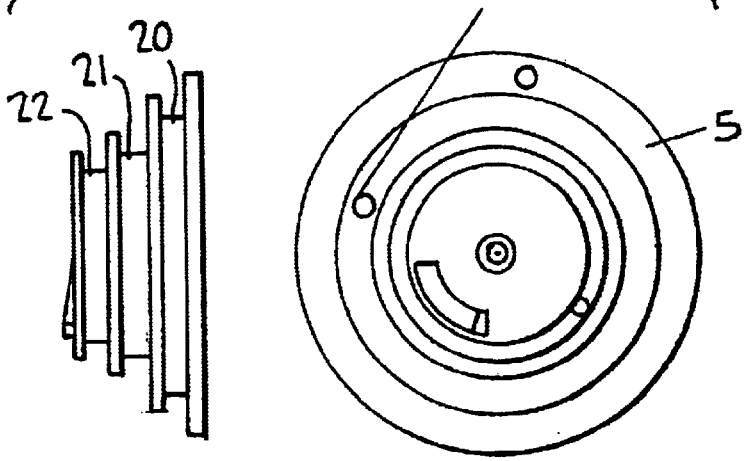
FIG. 5 shows a front and side view of a 3-stage pulley to obtain three different degrees of lengthening with the same angular rotation, with a wedge also present on one face
Figure 7:
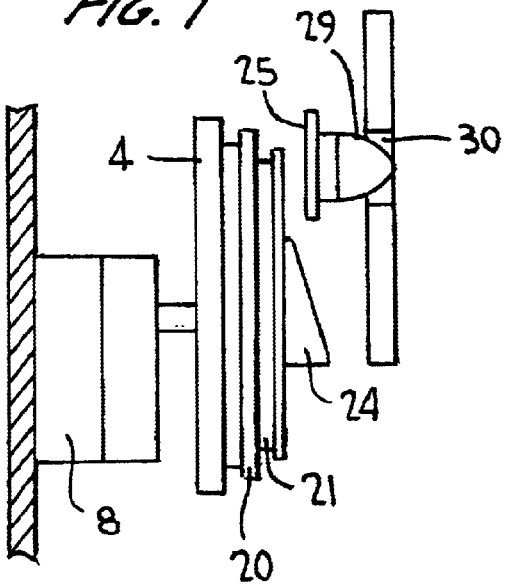
FIG. 7 is the side view of the doll where the left part of the Figure is sectioned close to one of the breast passage holes, and the details within are seen unsectioned.
Figure 8:
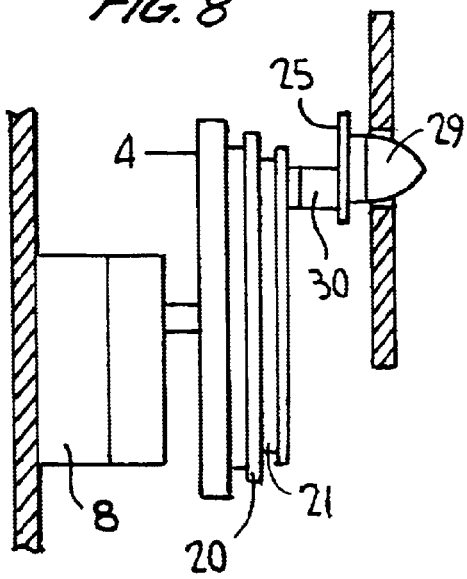
FIG. 8 is the view from above of the preceding Figure, where the left part of the Figure is sectioned close to the electric motor whereas the right part is sectioned near one of the breast passage holes and shows the extruded breast from the side.
Figure 8:
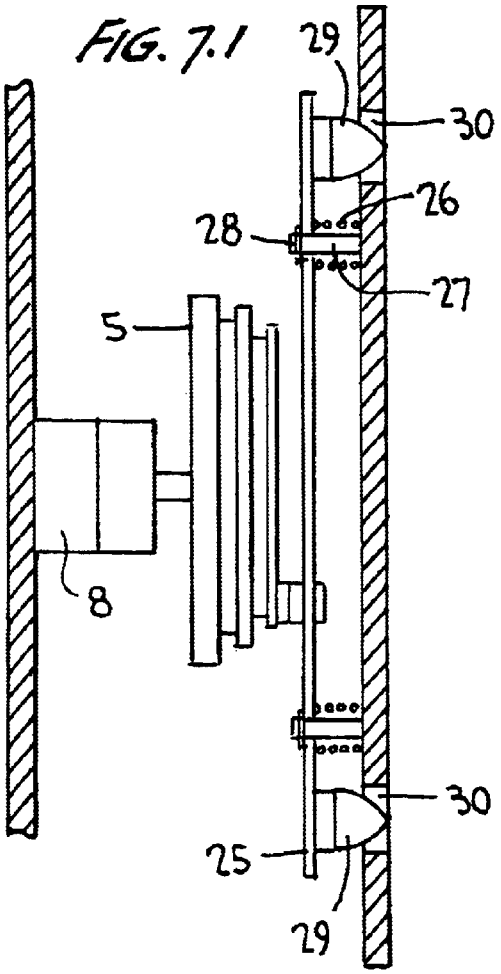
Figure 8:
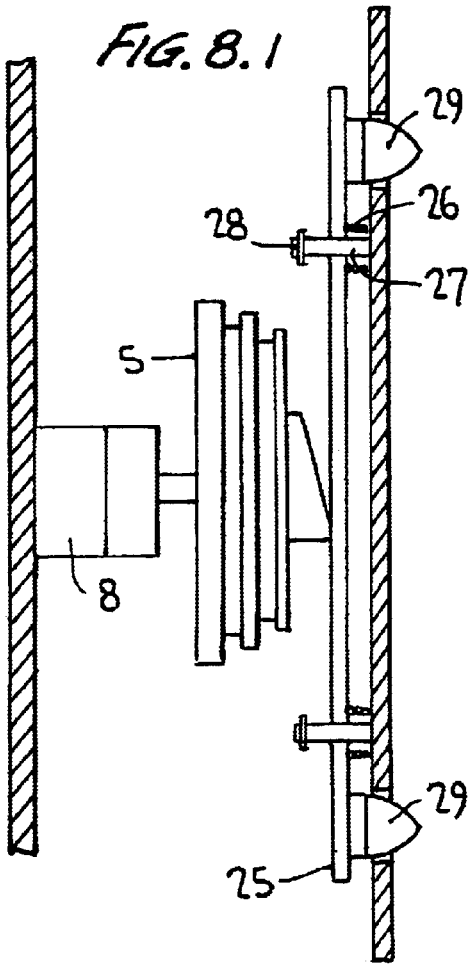

FIG. 5 shows a pulley 5 formed of 3 pulleys 20, 21 and 22 coupled in such a way as to create different extensions for the arms, legs and neck, or vice versa; as can be seen this pulley also presents the wedge 24. FIG. 7.1 sketches the breast of a doll seen from the side in longitudinal section performed on the outer casing. The same view but from above appears in FIG. 7. From both the Figures one notes that pulley 5 is fitted with wedge 24. When it rotates in the release stage, the wedge pushes the mobile plate 25 which is held in the retracted position by the action of the spring 26 positioned around the pin 27 solid with the outer casing and held by the locking ring 28. When the motor 8 has consent to release the cables 4, these lengthen, because the pulley 5 rotates and in the presence of the wedge 24 it will act on the mobile plate 25, which overcomes the reaction of the spring 26, allowing the mobile plate 25 to run, guided by the pins 27 until the wedge 2 and the mobile plate 25 reach the position indicated in FIGS. 8 and 8.1, where the breast 29 is shown, Connected to the mobile plate 25 it has emerged fully from the aperture 30.

Figure 6:
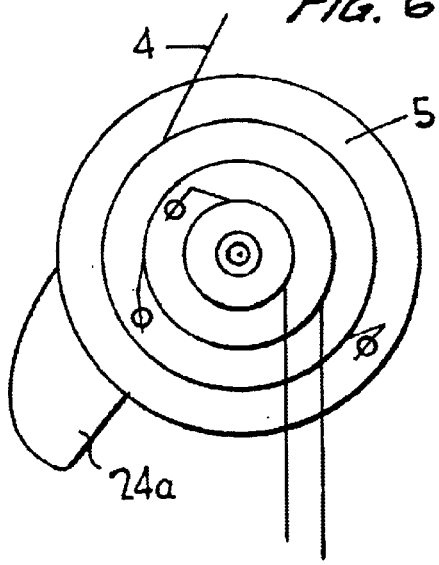
FIG. 6 shows a front and side view of a 4-stage pulley to obtain four different degrees of lengthening with the same angular rotation, with a wedge tangential to the pulley also present
Figure 9:
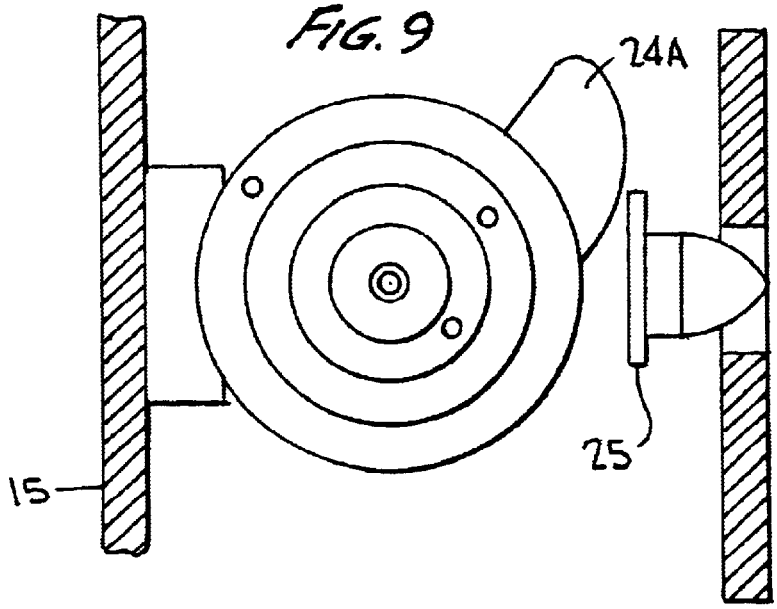
FIG. 9 is the side view of the doll in which the left part of the Figure is sectioned near the electric motor and the right part near one of the breast passage holes and the details within are shown not sectioned. The motor and pulley are inclined in such a way that the axis of rotation is almost parallel to the mobile plate and to the posterior part of the body.

FIG. 6 shows a wedge 24 placed radially on the outside of the pulley 5, because in some cases the motor could work inclined 90° with its axis parallel to the mobile plate 25 as indicated in FIG. 9, and then, to push the mobile plate 25, only the position of the wedge in relation to the pulley changes.

It can be observed from FIG. 2 that when all the components have been mounted, the spring 2 is mounted, with the cable 4 running within it, and then the spring 2 is allowed to run within the piece 9 and then the pieces 9 and 3 are brought into position, connecting the cable to the pulley 5 at point 5.1 to make it wrap around the pulley. The operations described are repeated for the two arms, the two legs and the neck and the front halves of the bust are mounted.

The accumulator and controlling electronics had been mounted earlier, so that the toy is then ready for use with few and simple operations.

What is claimed is:

1. Device for lengthening components of a doll body comprising:

an upper outer casing provided with holes for protrusion of breasts and a lower outer casing, said upper outer casing and said lower outer casing being constructed and arranged to slide in relation to each other;

upper limbs, lower limbs, and neck wherein each comprises a first telescopically sliding element and a second telescopically sliding element attached to the upper outer casing or the lower outer casing;

two elements attached to a mobile plate, said two elements comprising breasts;

connection cables linking the upper limbs, the lower limbs and neck through the upper casing and the lower casing;

springs operationally connected to each said first telescopically sliding element or said second telescopically sliding element;

mechanisms for winding and releasing of said connection cables;

an electric motor with reducer;

an accumulator;

an electronic circuit that controls operation of said motor; and a pulley with wedge constructed and arranged to move said mobile plate.

2. The device according to claim 1, wherein said mechanisms for winding and releasing are pulleys.

3. The device according to claim 1, wherein said mechanisms for winding and releasing are disks with cams.

4. Device according to claim 1, wherein the device has minimum dimensions in a resting position and wherein movement of the device causes activation of the electronic circuit which activates the motor which activates the reducer which sets in motion the mechanisms for winding and releasing of the cables which are drawn by the springs to provide mutual sliding of the first telescopic element and the second telescopic element, and rotation of the wedge which pushes the mobile plate outward for protrusion of the breasts from the body.

5. Device according to claim 1, wherein the pulley includes an axis of rotation at right angles to a plane of a rear part of the body and wherein the wedge functions in relation to the mobile plate approximately at right angles to the axis of the pulley.

6. Device according to claim 5, wherein the axis of rotation of the pulley is parallel to the rear part of the body to reduce axial dimension and approximately parallel the mobile plate.

7. Device according to claim 1, wherein the mobile plate is guided in movement by the wedge, pins fixed to the body and a spring.

8. Device according to claim 1, wherein the springs are held in an unlengthened position against a first point by the cables anchored at a second point in said upper limbs, said lower limbs, said neck and said lower body, and anchored at one of said mechanisms for winding and releasing.

9. Device according to claim 1, wherein one of said springs is located in the lower casing and is held in a lengthened or unlengthened position in relation to the upper casing by a cable fixed at a point anchored at one of said mechanisms for winding and releasing.

10. Device according to claim 2, wherein the pulleys include grooves of different diameters so that rotation of the pulleys results in a different lengthening of one of the connection cables as present in each groove.

11. Device according to claim 2, wherein the pulleys include pins positioned on different radii of a disk of one of the pulleys to provide for different lengthening of one of the connector cables as connected to the pins.

* * * * *